United States Patent [19]

Kaneko

[11] Patent Number: 4,669,699

[45] Date of Patent: Jun. 2, 1987

[54] DEVICE FOR ALTERING A PHYSICAL ANGLE FORMED TO COMMODITY TO BE TRANSFERRED

[75] Inventor: Yutaka Kaneko, Tokyo, Japan

[73] Assignee: Tetra Pak International Aktiebolag, Lund, Sweden

[21] Appl. No.: 774,236

[22] Filed: Sep. 9, 1985

[30] Foreign Application Priority Data

Sep. 10, 1984 [JP] Japan ..... 59-190450

[51] Int. Cl.[4] ..... B65B 61/00

[52] U.S. Cl. ..... 248/652; 248/664; 53/128

[58] Field of Search ..... 53/128, 383; 248/664, 248/667, 668, 670, 652, 75; 74/16

[56] References Cited

U.S. PATENT DOCUMENTS

| | | | |
|---|---|---|---|
| 1,703,099 | 2/1929 | Craddock | 248/664 X |
| 2,255,514 | 9/1941 | Miller | 248/664 |
| 2,298,087 | 10/1942 | Stechbart | 248/652 |
| 2,386,906 | 10/1945 | Mitchell et al. | 248/652 |
| 2,594,404 | 4/1952 | Debrie | 248/664 X |
| 4,584,819 | 4/1986 | Håkansson | 53/128 X |

FOREIGN PATENT DOCUMENTS

| | | | |
|---|---|---|---|
| 11140 | 2/1880 | Fed. Rep. of Germany | 248/652 |
| 315845 | 3/1934 | Italy | 248/664 |

*Primary Examiner*—Horace M. Culver

*Attorney, Agent, or Firm*—Koda and Androlia

[57] ABSTRACT

A device for changing angles of a cutter assembly, adhesive ejecting nozzles, etc. relative to articles fed by a conveyor which includes a bracket provided with a U-shaped guide groove and a guide surface formed along the guide groove; a moving piece which moves along the guide groove and on the guide surface; and fixing means for fixing the moving piece, the cutting assembly or adhesive injection nozzles provided on the moving piece may be mounted at any desired angle along the guide groove. The device is further placed on the side of a conveyor such that the distance between the center of the commodity and any position between both ends of the guide groove can be kept consistent.

1 Claim, 14 Drawing Figures

FIG. 1
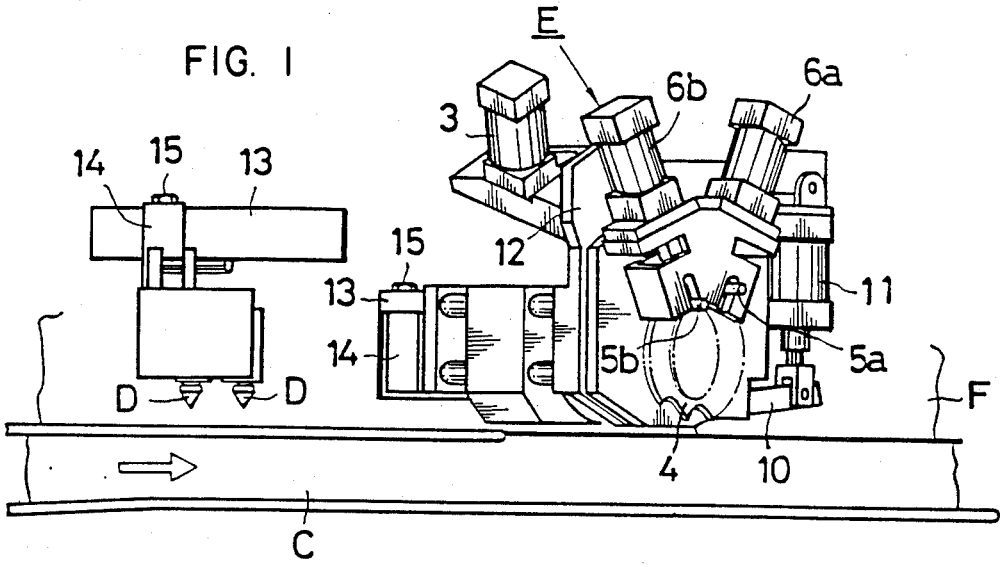
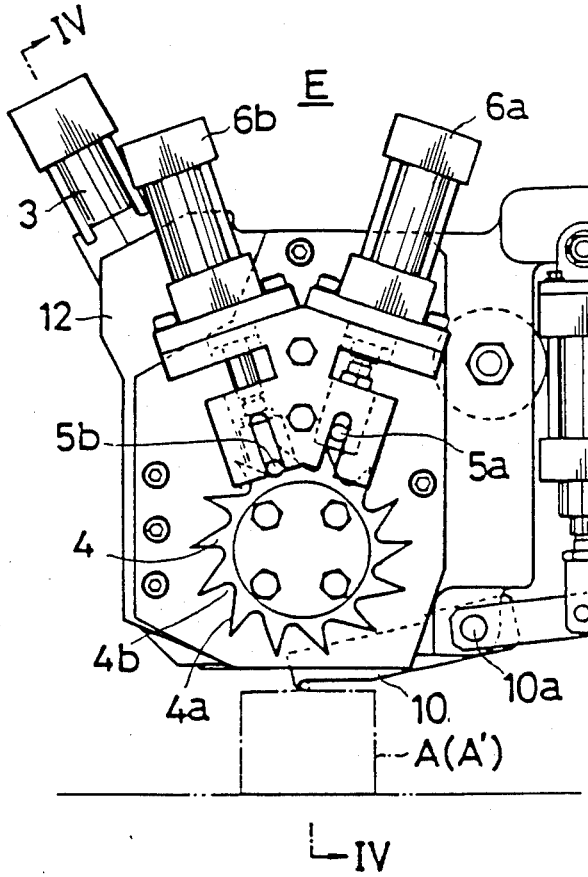
FIG. 2

DEVICE FOR ALTERING A PHYSICAL ANGLE FORMED TO COMMODITY TO BE TRANSFERRED

BACKGROUND OF THE INVENTION

1. Field of the Invention

The present invention relates to a device for altering a physical angle formed relative to a commodity to be transferred which is disposed on the side of a commodity conveyance passage, and more specifically to a device for changing the angle of a cutting assembly, etc. with regard to the center of the side face of the commodity to be transferred.

2. Prior Art

Milk and juice are sold in a food packaging container A, which is called a packing container as shown in FIG. 13, or in a container A′ as illustrated in FIG. 14, which is normally larger than the container A with a straw package b attached diagonally on the side surface thereof.

In order to automatically attach the package b to the external side face of the food package container A or A′, conventionally the following system is employed. A continuous bag B, which is a series of packages b respectively containing a straw, is sealed at predetermined intervals. The continuous bag B is cut into individual packages b at part c which is between the sealed straws. Each of the packages b is then attached to the external side face of the container A or A′, which is fed through a conveyance passage. In the above process, a special adhesive is put on in advance at at least two points in the diagonal direction on the external side face of the container A or A′.

When the foregoing operations are conducted, the package b or the points on which the adhesive is applied must be positioned along a slant with regard to the container A or A′ which is conveyed in a vertically standing state. In other words, the package b must be attached diagonally on the container.

In order to meet such a requirement, a device for cutting the continuous bag B into packages or a pair of upper and lower adhesive injection nozzles have been set at a slant on the side of the container conveyance passage. However, such a setting system is extremely troublesome, because the above-mentioned devices must be adjusted to different positions depending upon the size of the containers. Furthermore, if the size of the containers to be handled changes, the distance from the conveyance passage to the center of the side surfaces of the containers also changes. Therefore, sometimes it is impossible to consistently position the same brackets, whereon the cutting device or nozzles are mounted, diagonally at the oenter of the individuaI package b.

Further, when mounting the package b on the diagonal direction indicated by the dashed lines in FIGS. 13 and 14, the physical angle of the above-mentioned device must be changed too.

In addition, when attaching packages containing, for example, a spoon to containers for yogurt or ice cream, the same operation as mentioned above is required to adjust the device to the proper positions.

SUMMARY OF THE INVENTION

The object of the present invention is to provide a device which performs the foregoing operations easier than in the prior art. The device includes a bracket possessing a guide section, internally projected and arc-shaped, whose distance from the center of the side face of a commodity to be transferred and the entire guide section is kept the same at any point. A moving piece is detachably mounted in the guide so as to move along the guide, and a cutting device or a pair of upper and lower adhesive injection nozzles are fixed to the moving piece.

By means of the above arrangement, the cutting device for cutting continuous packages or a pair of upper and lower adhesive injection nozzles which are mounted on the moving pieces can have their physical angle changed with regard to the commodities to be fed through the conveyance passage. Particularly, since the arc-shaped guide section of the bracket can keep the distance between the center of the side face of the commodity and the moving pieces the same no matter where the position of the moving pieces is, it always puts the cutting device or adhesive injection nozzles mounted thereon on a line diagonally passing through the center of the side of the commodity. Therefore, it is possible for the package b to be attached along the line passing through the center of the side face of the commodity being conveyed by means of the cutting device and adhesive injection nozzles which are mounted on the moving piece.

BRIEF DESCRIPTION OF THE DRAWINGS

The accompanying drawings illustrate the embodiment according to the present invention, in which:

FIG. 1 is a plan view showing the state where, using a cutting device for cutting continuous packages and a pair of upper and lower adhesive injection nozzles are disposed on the side of a conveyance passage and provided on a device of the present invention;

FIG. 2 is a front view of the cutting device;

DETAILED DESCRIPTION OF THE INVENTION

The description of the embodiment aocording to the present invention will be made in conjunction with the accompanying drawings.

FIG. 1 illustrates a pair of upper and lower adhesive injection nozzles D and a cutting device E for cutting a series of continuous packages, both of them being provided next to the other on one side of a conveyance passage C.

Figure 3:
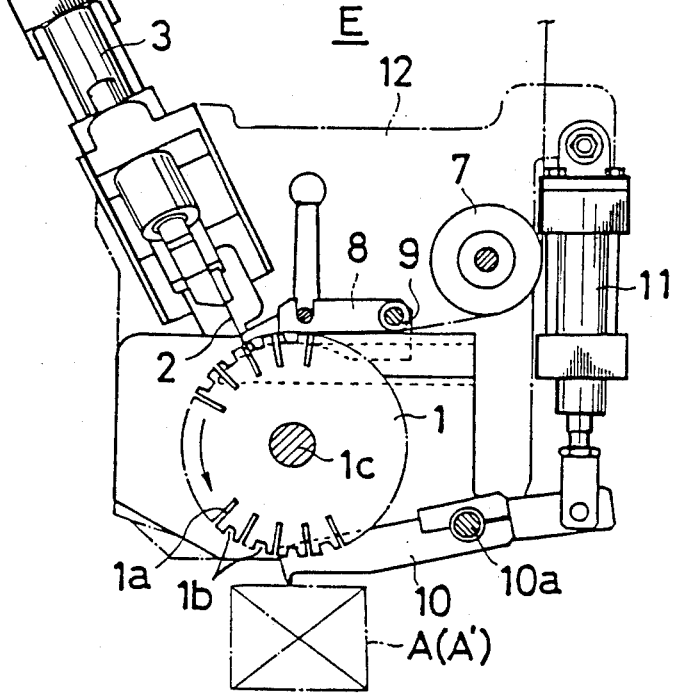
FIG. 3 is an enlarged front view of the internal mechanism of the cutting device with a portion thereof shown in vertical cross-section.
Figure 4:
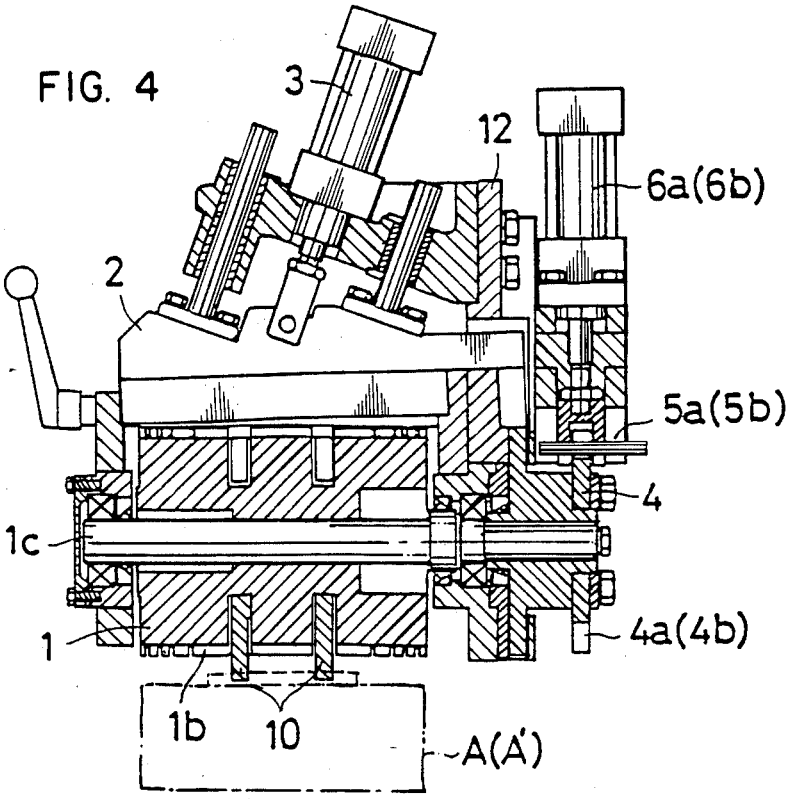
FIG. 4 is a sectional view taken along the line IV—IV of FIG. 2.
Figure 5:
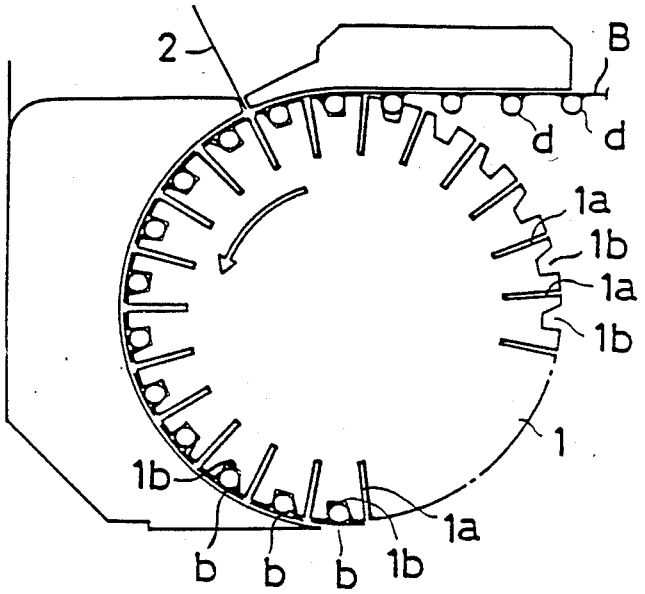
FIG. 5 is a front view showing the continuous packages being supplied to the cutting device.

As shown in FIGS. 2 through 4, the cutting device E includes a cutting drum 1 which rotates intermittently and a cutter 2 provided in a groove 1*a* formed in the drum 1.

The cutting drum 1 feeds continuous packages B intermittently as it rotates. In other words, the packages B are fed a distance corresponding to each package b (one pitch by one pitch). A cylinder 3 pushes the cutters 2 into the notch groove 1*a* each time the drum stops rotating, cutting the continuous packages B into individual packages b, and, at the same time, the cutting drum 1 rotates and consecutively feeds out the packages b. In that case, a projecting part d of the article such as straws, spoons, etc. in the package b, is fitted in each of the feed grooves 1*b* formed between the notch grooves 1*a* of the cutting drum 1. Except for the above system wherein the cutter moves back and forth by the cylinder 3, another system wherein the cutter passes the notch groove 1*a*, while it is revolving and rotating on its own axis and cuts the continuous packages B into the packages b can also be used.

In order for the cutting drum 1 to perform intermittent rotation as shown in FIGS. 2 and 4, a cam wheel 4 is concentrically fixed to a shaft 1*c* of the cutting drum 1 and two pins 5*a* and 5*b* are disposed on the outside of the cam wheel 4 so that one of the pins fits in the entrance 4*a* of one groove and the other pin fits in the bottom 4*b* of another groove of the cam wheel 4 by means of two cylinders 6*a* and 6*b*. In FIG. 2 the pin 5*b* is fitted in the bottom 4*b* of the groove of the cam wheel 4. When the cylinder is actuated, the pin 5*b* disengages from the groove 4*b*. At this moment, another cylinder 6*a* actuates the pin 5*a* to push it into the entrance 4*a* of another groove of the cam wheel 4. Accordingly, as soon as the cam wheel 4 is rotated counterclockwise by one pitch as shown in FIG. 2, the cylinder 6*b* is actuated again to engage the pin 5*b* into the bottom 4*b* of the next groove, thereby stopping the rotation of the cam wheel 4. Thus, alternative actuation of the two cylinders 6*a* and 6*b* intermittently rotates the cam wheel 4, resulting in the intermittent rotation of the cutting drum 1 which is mounted on the same shaft as that of the cam wheel 4.

The continuous packages B are fed to the cutting drum 1 through a guide roller 7 and a guide surface 9 of an attachment 8 as shown in FIG. 3. On the other hand, a lever 10 is provided on the exterior of the cutting drum 1 and on the opposite side of the cutter 2. This lever 10 takes the individual packages b, which have been cut out by the cutter 2 out, from the external periphery of the cutting drum 1 and pushes the same to the side of the containers A or A′ which are fed to the side thereof. The lever 10 is swingably moved around the shaft 10*a* by an actuation cylinder 11.

The cutting device E is, as shown in FIGS. 2 through 4, formed as a single unit is mounted on a plate 12 and is disposed on the side of the conveyance passage C as shown in FIG. 1.

Figure 6:
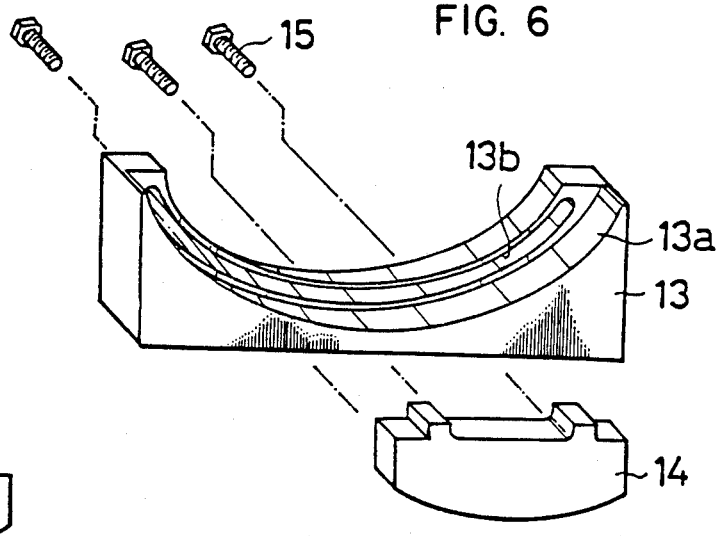
FIG. 6 is an exploded perspective view showing a device for changing the physical angle relative to the commodities of the present invention.
Figure 7:
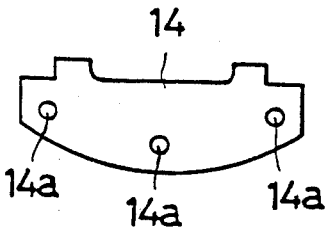
FIG. 7 is a rear view of a moving piece in a guide of the angle changing device of FIG. 6.

The cutting device E is disposed on the side of the conveyance passage C, as shown in FIG. 6, by the use of a bracket 13 fixed to a frame F located at the side of the conveyance passage C, a moving piece 14 which is mounted on the bracket 13, and a fixture 15 for securely fitting the moving piece 14 to the bracket 13.

A guide section, internally projecting and of an arc or U-shape, is formed on the bracket 13. The distances between the center (shown by O in FIGS. 8 through 10) of the side face of the container A which is fed through the conveyance passage C (or a conveyor) and the guide section is set to be equal at any point. In the present embodiment, the guide section includes a guide surface which internally projects and is of an arc or U-shape and a guide groove 13*b* which also internally projects and is of an arc or U-shape, provided next and parallel to each other.

A moving piece 14 is fitted to the bracket 13. In the present embodiment, bolts 15 are inserted from the back of the guide groove 13*b*, and the front ends of the bolts 15 are screwed into screw holes 14*a* provided on the rear side of the moving piece 14. The lower surface of the moving piece 14 is shaped in an arc so that the moving piece 14 is able to move or slide on the guide surface 13*a* of the bracket 13. Thus, the moving piece 14 can be positioned at any desired angle on bracket 13. Namely, the moving piece 14 can be fixed at any desired position by loosening the fixture (bolts) 15, moving the moving piece 14 along the guide surface 13*a* of the bracket 13, and tightening the bolts 15 when the moving piece 14 is in the desired position.

Since such an arrangement makes it easy to change the position of the moving piece 14 on the bracket 13, the physical angle of the cutting device E can easily be changed when the cutting device for cutting the continous packages B is mounted on the moving piece 14.

Figure 8:
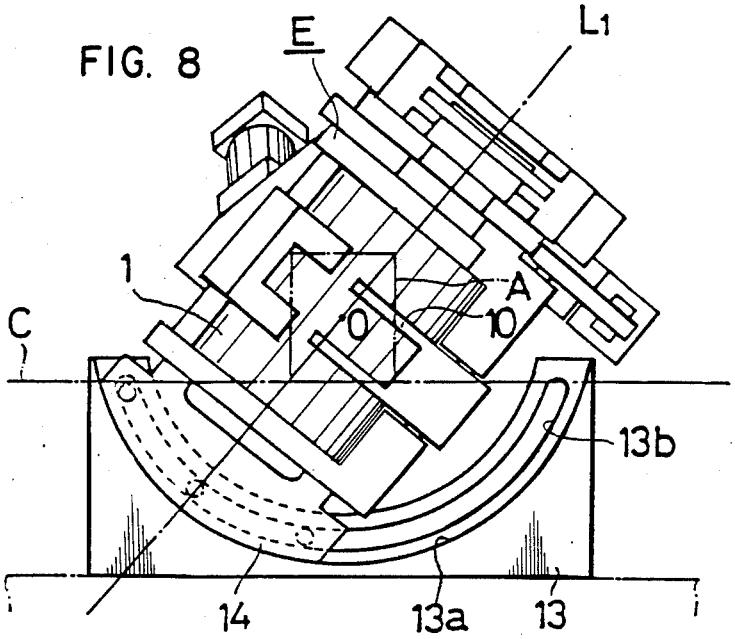
FIGS. 8 and 9 are side views showing the continous cutting bag device mounted on the angle changing device with the cutting device's working angle being changed.
Figure 9:
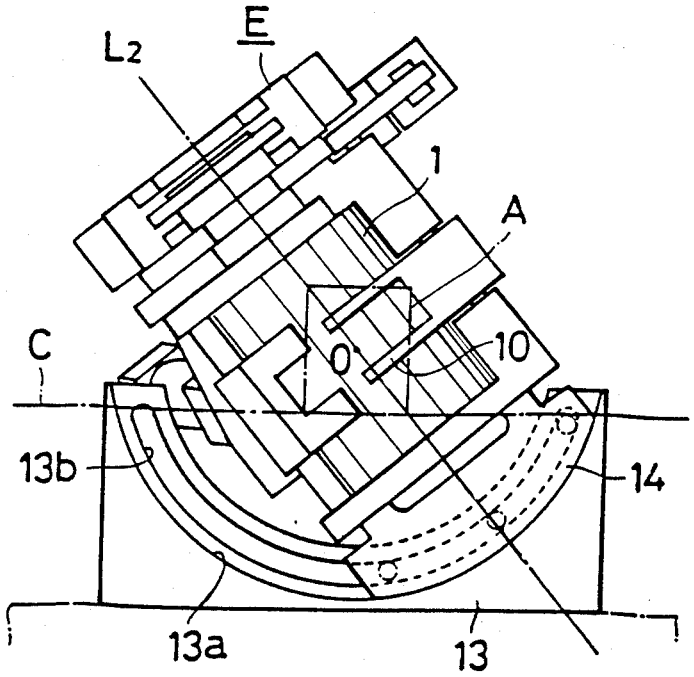

FIG. 8 illustrates a case wherein the moving piece 14 is set at the left end limit of the guide groove of the bracket 13, while FIG. 9 shows a case wherein the moving piece 14 is set at the right end limit of the bracket 13. The physical angles of the cutting device E, mounted on the moving piece 14, are opposiie to each other in FIGS. 9 and 10. However, in either case, the axis line of the cutting drum 1 of the cutting device E is located on the line passing through the center O of the side face of the container A which is fed through the conveyance passage C. In particular, when the moving piece 14 is set at the positions of FIGS. 8 and 9 with regard to the bracket 13, the cutting device E enables the package b to be adhered to the diagonal line $L_1$ or $L_2$ on the external side face of the container A since the axis line of the cutting drum is located on the diagonals $L_1$ and $L_2$ of the container A.

Figure 10:
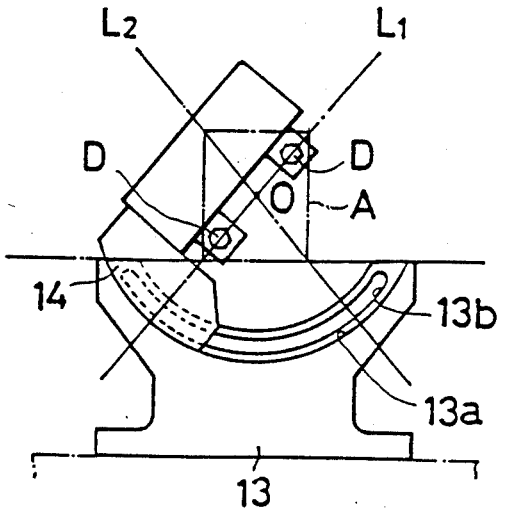
FIG. 10 is a side view showing a pair of upper and lower adhesive injection nozzles mounted on the angle changing device of the present invention.

FIG. 10 illustrates another embodiment of the present invention wherein in place of the above-mentioned cutting device E, a pair of upper and lower adhesive injection nozzles D are mounted on the moving piece 14. Similar to the above-mentioned cutting device E, the upper and lower adhesive injection nozzles D can be positioned on the line passing through the center O of the side face of the container A which is fed through the conveyance passage C. In particular, by setting the moving piece 14 at the position shown by the solid line in FIG. 10 with respect to the bracket 13 (the moving piece being at the left end on the bracket 13) at or reversably at the right end of the bracket 13, the upper and lower adhesive injection nozzles D mounted on the moving piece 14 can be positioned on the diagonals $L_1$ and $L_2$ of the container A. Thus, an adhesive can be applied to two points on the container along the diagonals $L_1$ and $L_2$. Accordingly, by pressing the package b on the container A, it can be adhered diagonally on the external side face of the container A.

In the above embodiment, in order to smoothly mount and slide the moving piece 14 on the bracket 13 to maintain consistent positioning of the moving piece 14 and the center O of the side face of the container A which are fed through the conveyance passage C and to easily mount the moving piece 14 on the bracket 13, the guide section on the bracket 13 is constructed with the arc-shaped guide surface 13*a* and the guide groove 13*b*. However, the guide section may be constructed with only either the guide surface 13*a* or the guide groove 13*b*.

In the case wherein only the guide surface 13*a* is formed in the guide section, it may be necessary to shape the lower surface of the moving piece 14 to be in an identical arc to that of the guide surface 13*a* in that case, since the bolts 15 are not used as the fixing means, a substitute method thereto must be employed. Such a substitute method is a clamp for fixing the moving piece or screwing the bolts from the front side of the moving piece 14 into the bracket 13.

On the other hand, if only the guide groove 13*b* is formed in the bracket 13 without providing the guide surface 13*a*, the moving piece 14 can be easily mounted on the bracket 13 only by screwing in the bolts 15 which are inserted into the moving piece 14 from the back thereof. In that case, it may not be necessary to make the lower surface of the moving piece 14 arc-shaped.

Figure 11:
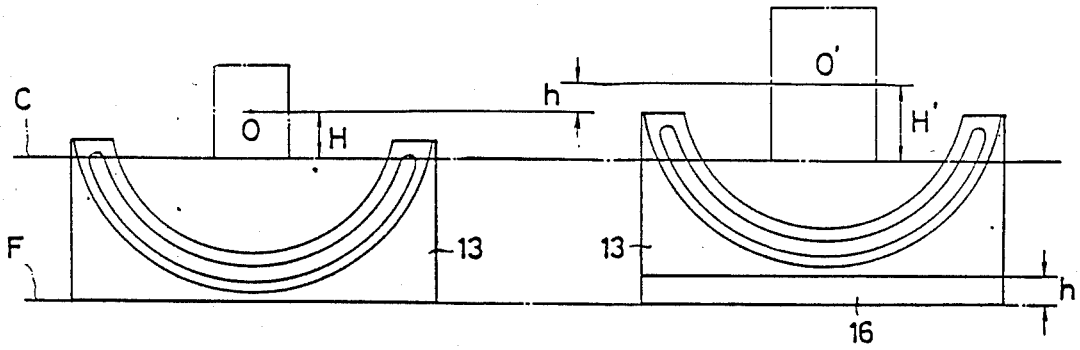
FIG. 11 is a side view showing two methods of mounting the angle changing device according to the present invention, when the size of the commodities fed through the conveyance passage are different.
Figure 12:
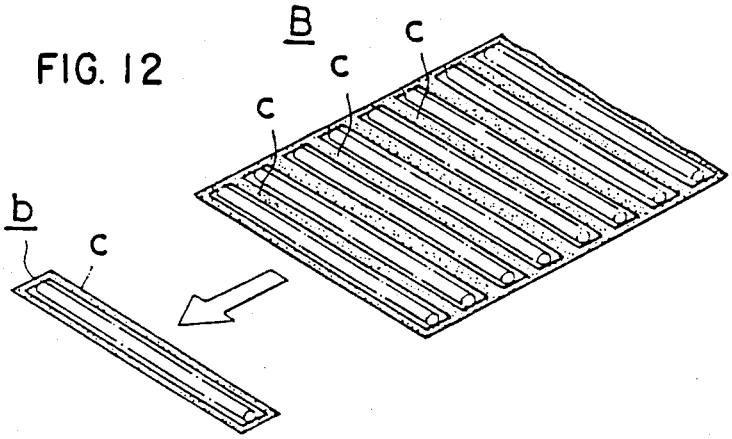
FIG. 12 is a perspective view of a part of the continuous packages containing straws.
Figure 13:
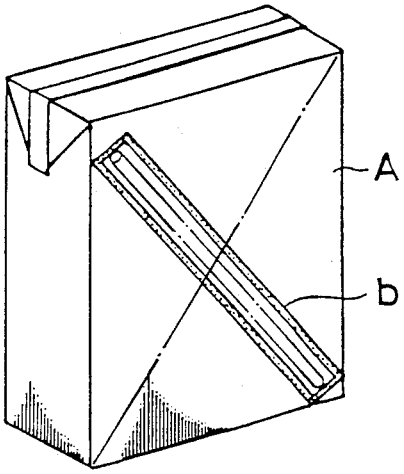
FIGS. 13 and 14 are perspective views of the individual packages cut out from the continuous packages to be attached to different sizes of food packaging containers.
Figure 14:
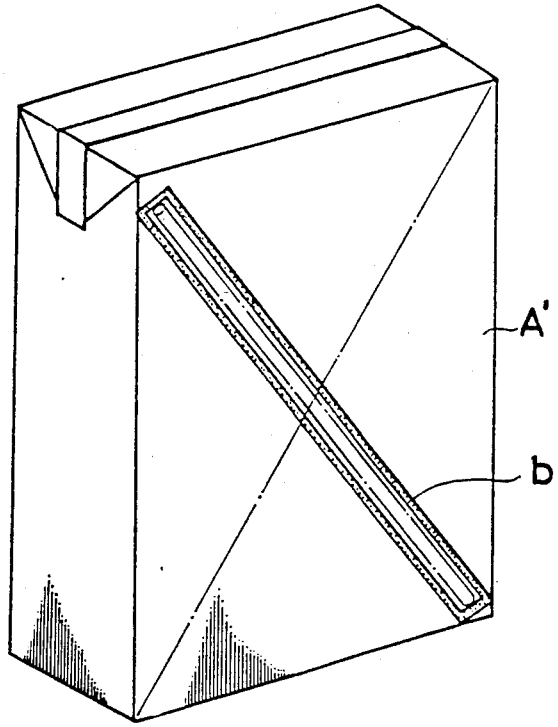

FIG. 11 illustrates how to mount the bracket 13 in the case where the sizes of the containers fed through the conveyance passage C are different.

Since the distance H, which is between the conveyance passage C and the center O of the smaller food packaging container A conveyed. and the distance H', which is between the conveyance passage C and the center O' of the larger food packaging container A' conveyed, is different, the bracket 13 used for the smaller container A cannot be used when the bigger container A' is handled. For this reason, other brackets for handling the food packaging container A' may be necessary. However, an auxiliary base 16 having a height h ($h=H'-H$) which is equal to the difference between H' and H can be used as shown in FIG. 11. Thus, the bracket 13 can be used for the smaller container A. Also, as shown in FIG. 11, if the auxiliary base 16 with the height h is put on a frame F, the bracket 13 used for the smaller containers A can also be used for the bigger containers A.

By means of such an arrangement, the distances from the centers O and O' of the two containers A and A' to the guide section of the bracket 13 become equal to each other, even if the distances H and H' from the conveyance passage C to the centers O and O' of these contains A and A' are different from each other. Accordingly, the bracket 13 used for the smaller container. A can be utilized also for the larger container A', and thus the device of the present invention makes the operational process remarkably more convenient without requiring any other special bracket.

According to the present invention, the physical angle of the device, which is disposed on the side of the commodity to be transferred through the conveyance passage can be altered easily and accurately with regard to the commodity to be transferred. In particular, according to the present invention, the above-mentioned device can be easily and accurately disposed on the line passing through the center of the side face of the commodity to be transferred.

I claim:

1. An apparatus for altering a physical angle formed between a device provided adjacent a conveyance passage for a commodity and a center of a side face of said commodity to be transferred through said conveyance passage, comprising:

a bracket disposed adjacent said conveyance passage;

an arc shaped groove provided in said bracket, said arch shaped groove being arranged and configured such that said center of said side face of said commodity is equidistant from any point on said arc shaped groove; and a member to be guided, which is slidable along the arc shaped groove, detachably mounted on said bracket for fitting said device thereon, whereby the physical angle of the device can be altered relative to said commodities to be transferred.

* * * * *